US010292543B2

(12) United States Patent
Ruiz et al.

(10) Patent No.: US 10,292,543 B2
(45) Date of Patent: May 21, 2019

(54) ROLL STABILIZING SUPPORT STRUCTURE

(71) Applicant: RUIZ GARRISON COLLABORATION LLC, Elko, NV (US)

(72) Inventors: Sheila Ruiz, Elko, NV (US); Jared Garrison, Elko, NV (US)

(73) Assignee: RUIZ GARRISON COLLABORATION, LLC, Elko, NV (US)

( * ) Notice: Subject to any disclaimer, the term of this patent is extended or adjusted under 35 U.S.C. 154(b) by 410 days.

(21) Appl. No.: 14/994,043

(22) Filed: Jan. 12, 2016

(65) Prior Publication Data

US 2016/0198911 A1 Jul. 14, 2016

Related U.S. Application Data

(60) Provisional application No. 62/102,479, filed on Jan. 12, 2015.

(51) Int. Cl.

| | |
|---|---|
| ***A47K 10/38*** | (2006.01) |
| ***B65H 16/06*** | (2006.01) |
| ***B65H 75/18*** | (2006.01) |

(52) U.S. Cl.

CPC ..... *A47K 10/38* (2013.01); *B65H 16/06* (2013.01); *B65H 75/185* (2013.01); *A47K 2010/389* (2013.01)

(58) Field of Classification Search

CPC .... B65H 16/06; B65H 18/028; B65H 75/185; B65H 75/187; A47K 10/38; A47K 2010/389

See application file for complete search history.

(56) References Cited

U.S. PATENT DOCUMENTS

| | | | | |
|---|---|---|---|---|
| 1,086,946 A * | 2/1914 | Smith | ..... | A47K 10/38 242/595 |
| 1,310,019 A * | 7/1919 | Hosfeldt | ..... | A47K 10/36 225/14 |
| 1,515,382 A * | 11/1924 | Cheesman | ..... | B65H 16/06 242/573.5 |
| 1,557,700 A | 10/1925 | Jaderlund | | |
| 1,581,279 A * | 4/1926 | Wipfli | ..... | B65H 75/185 242/613.5 |
| 2,565,994 A | 8/1951 | Sevenich | | |

(Continued)

*Primary Examiner* — William E Dondero

(74) *Attorney, Agent, or Firm* — Kunzler Bean & Adamson

(57) ABSTRACT

An apparatus for stabilizing a roll of material includes a first and a second conical base. The first conical base has a first through-hole extending completely through the first conical base along a first central axis. The first conical base also has a first tapering section circumscribing and concentric with the first through-hole, the first tapering section configured to be inserted into a first opening of a central bore of the roll. The second conical base has a second through-hole extending completely through the second conical base along a second central axis. The second conical base has a second tapering section circumscribing and concentric with the second through-hole, the second tapering section configured to be inserted into a second opening opposite the first opening of the central bore of the roll. Engagement between the roll and the first and second conical base structures operably stabilizes rotation of the roll.

17 Claims, 7 Drawing Sheets

(56) References Cited

U.S. PATENT DOCUMENTS

| | | | | | |
|---|---|---|---|---|---|
| 2,696,354 | A * | 12/1954 | Novick | B65H 16/06 | 242/573.3 |
| 3,519,216 | A * | 7/1970 | Rienzi | B65H 75/185 | 242/599.2 |
| 3,601,328 | A | 8/1971 | McClung | | |
| 3,623,676 | A | 11/1971 | Eckels | | |
| 4,284,995 | A * | 8/1981 | Gordon | G06K 13/26 | 242/129.51 |
| 4,759,510 | A | 7/1988 | Singer | | |
| 5,186,099 | A * | 2/1993 | Qing | B65B 63/02 | 100/35 |
| 6,405,972 | B1 | 6/2002 | Wakam | | |
| 6,450,439 | B1 | 9/2002 | van Rees | | |
| 8,206,003 | B1 | 6/2012 | LaBarge | | |
| 2014/0284411 | A1 * | 9/2014 | Perez | B65H 75/185 | 242/130 |

* cited by examiner

ROLL STABILIZING SUPPORT STRUCTURE

CROSS-REFERENCE TO RELATED APPLICATION

This application claims the benefit of U.S. Provisional Patent Application No. 62/102,479 filed Jan. 12, 2015, which is incorporated herein by reference.

FIELD

This invention relates to rolls of material and more particularly relates to a support structure for stabilizing rolls of material.

BACKGROUND

Rolls of material, such as toilet paper, paper towels, plastic wrap, aluminum foil, or the like, often come in different sizes. In other words, bores extending through the cylindrical rolls of material often have various lengths and/or diameters. Conventional roll holders are typically sized to fit the smallest sized roll. In effect, roll holders are usually smaller than the central bores of the rolls they support and thus the rotation of the roll about the roll holder is loose and unbalanced. Further, many central bores have a non-uniform or oblong cross-sectional shape (i.e., smashed or compressed rolls), thus further contributing to the unbalanced and wobbly rotational motion of the roll.

SUMMARY

From the foregoing discussion, it should be apparent that a need exists for an apparatus and method that stabilizes the rotation of a roll of material. The subject matter of the present application has been developed in response to the present state of the art, and in particular, in response to the problems and needs in the art that have not yet been fully solved by currently available roll holders. Accordingly, the present disclosure has been developed to provide an apparatus and method of use that overcome many or all of the above-discussed shortcomings in the art.

According to one embodiment, disclosed herein is an apparatus for stabilizing a roll of material. The apparatus includes a first conical base and a second conical base. The first conical base has a first through-hole extending completely through the first conical base along a first central axis. The first conical base also has a first tapering section circumscribing and concentric with the first through-hole, the first tapering section configured to be inserted into a first opening of a central bore of the roll. The second conical base has a second through-hole extending completely through the second conical base along a second central axis. The second conical base has a second tapering section circumscribing and concentric with the second through-hole, the second tapering section configured to be inserted into a second opening opposite the first opening of the central bore of the roll. Engagement between the roll and the first and second conical base structures operably stabilizes rotation of the roll.

In one implementation, the first and second conical base structures have first and second flange sections, respectively. In such an implementation, the first and second tapering sections extend from the first and second flange sections, respectively. The first and second flange sections may have roll-facing surfaces that engage opposite ends of the roll to facilitate at least one of guided unwinding and guided winding of the material of the roll. In another implementation, swappable end caps are detachably coupleable to the first and second flange sections.

According to another implementation, at least portions of inner surfaces of the first and second-through holes are configured to directly engage a roll holder shaft extending therethrough. In such an implementation, a minimum diameter of the first and second-through holes may be at most 0.25 inches larger than a maximum diameter of the roll holder shaft. In such an implementation, the first and second central axis's of the first and second conical bases, respectively, are substantially coaxial with a third central axis of the roll holder shaft.

In one implementation, the first and second conical bases are detachably coupleable with each other. For example, the first and second conical bases may have complimentary connection features that facilitate the detachable coupling with each other. In another implementation, the apparatus may further include a connecting rod positionable between the first and second conical bases so that the first and second conical bases are detachably coupleable together via the connecting rod.

In another implementation the apparatus includes first and second peripheral rods. The first and second peripheral rods are coupleable between a roll holder bracket and at least one of the flange section and the through-hole of the first and second conical bases, respectively.

Also disclosed herein is another embodiment of an apparatus for stabilizing a roll of material. The apparatus includes a first conical base having a first through-hole extending completely through the first conical base along a first central axis. The first conical base has a first tapering section circumscribing and concentric with the first through-hole. The first tapering section is also configured to be inserted into a first opening of a central bore of the roll. The apparatus also includes a second conical base having a second through-hole extending completely through the second conical base along a second central axis. The second conical base has a second tapering section circumscribing and concentric with the second through-hole. The second tapering section is configured to be inserted into a second opening opposite the first opening of the central bore of the roll. Still further, the apparatus includes a roll holder bracket and a roll holder shaft. The roll holder bracket is configured to be secured (e.g., mounted) to a wall and the roll holder bracket has two arms. The roll holder shaft is configured to extend between the two arms of the roll holder bracket and configured to extend through the first and second-through holes of the first and second conical base structures, respectively, wherein at least portions of inner surfaces of the first and second-through holes are configured to directly engage the roll holder shaft. Engagement between the roll and the first and second conical base structures operably stabilizes rotation of the roll.

According to one implementation, the first and second conical base structures have first and second flange sections, respectively. The first and second tapering sections extend from the first and second flange sections, respectively. In such an implementation, the first and second flange sections may have roll-facing surfaces that engage opposite ends of the roll to facilitate at least one of guided unwinding and guided winding of the material of the roll. The apparatus may also include swappable end caps that are detachably coupleable to the first and second flange sections.

In one implementation, a minimum diameter of the first and second-through holes is at most 0.25 inches larger than a maximum diameter of the roll holder shaft. In such a configuration, the first and second central axis's of the first and second conical bases, respectively, are substantially coaxial with a third central axis of the roll holder shaft. According to another implementation, at least portions of inner surfaces of the first and second-through holes are configured to directly engage a roll holder shaft extending therethrough. In one implementation, the first and second conical bases are detachably coupleable with each other. For example, the first and second conical bases may have complimentary connection features that facilitate the detachable coupling with each other. In one implementation, a connecting rod is coupled between the first and second conical bases.

Also disclosed herein is one embodiment of a method for stabilizing rotation of a roll of material. The method includes inserting a first tapering section of a first conical base into a first opening of a central bore of the roll. The first conical base has a first through-hole extending completely through the first conical base along a first central axis. The method further includes inserting a second tapering section of a second conical base into a second opening opposite the first opening of the central bore of the roll. Once again, the second conical base has a second through-hole extending completely through the second conical base along a second central axis. The method further includes connecting the first tapering section of the first conical base to the second tapering section of the second conical base and inserting a roll holder shaft through the first and second central axis's of the first and second conical bases, respectively. The method includes engaging the roller holder shaft to a roll holder bracket.

Reference throughout this specification to features, advantages, or similar language does not imply that all of the features and advantages that may be realized with the present disclosure should be or are in any single embodiment of the disclosure. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. These features and advantages of the present disclosure will become more fully apparent from the following description and appended claims, or may be learned by the practice of the disclosure as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the following description, numerous specific details are provided. One skilled in the relevant art will recognize, however, that the subject matter of the present application may be practiced without one or more of the specific details, or with other methods, components, materials, and so forth. In other instances, well-known structures, materials, or operations are not shown or described in detail to avoid obscuring aspects of the disclosure. Also, like reference numbers refer to different embodiments of the same component (e.g., 102 and 202).

Figure 1A:
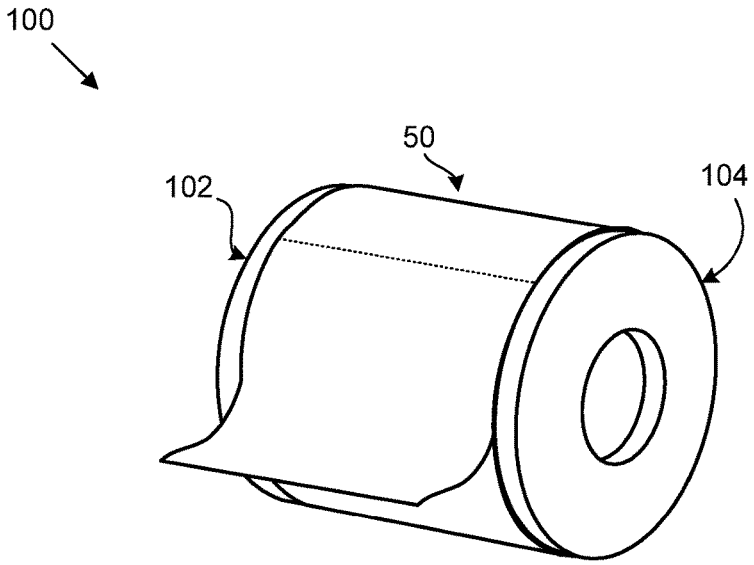
FIG. 1A is a perspective view of an apparatus for stabilizing rotation of a roll of material, according to one embodiment.
Figure 1B:
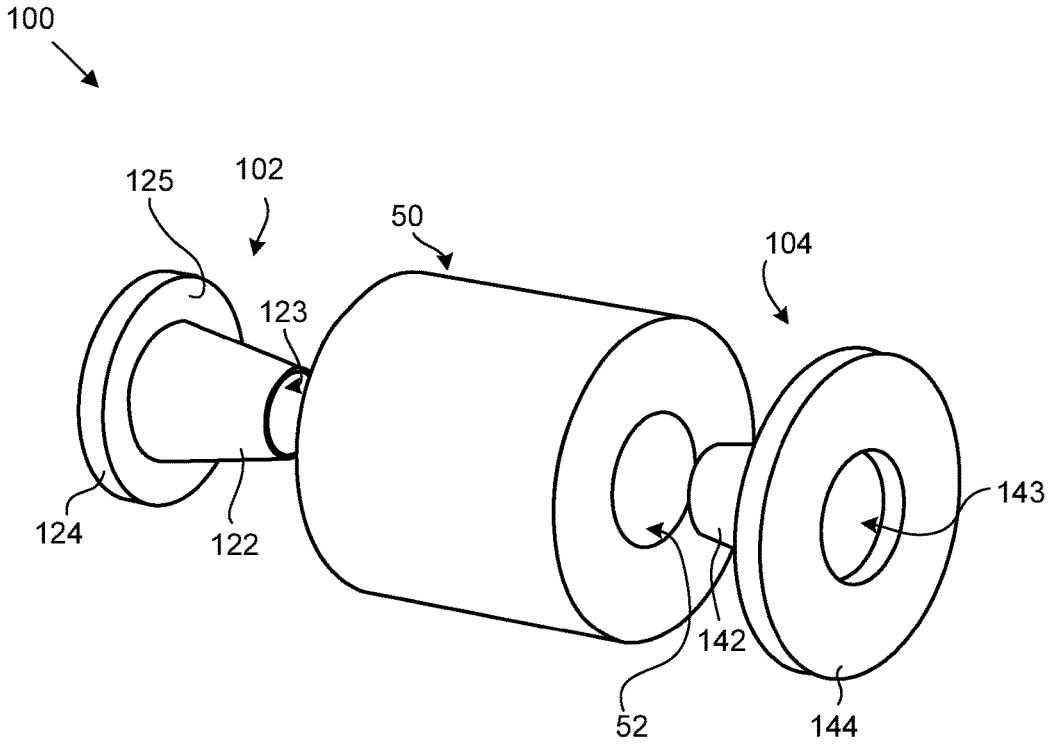
FIG. 1B is a perspective exploded view of the apparatus shown in FIG. 1A, according to one embodiment.

FIG. 1A is a perspective view of an apparatus 100 for stabilizing rotation of a roll 50 of material, according to one embodiment, and FIG. 1B is a perspective exploded view of the apparatus 100 show in FIG. 1A. The roll 50 of material may be any of various products, such as toilet paper, paper towels, wax paper, parchment paper, butcher paper, plastic sheets, metallic foils, etc. In other words, any material that is sold or provided in a rolled planar sheet.

As mentioned above in the Background section, rolls 50 are often employed for use with a roll support member. The roll support member (e.g, a spring-loaded roll support shaft) extends through the central bore 52 of the roll 50, thereby enabling rotation of the roll 50 about the roll support member, thus allowing a user to unwind (or wind) the material of the roll 50. However, the shape, size, configuration, and overall condition of rolls 50 may vary depending on the type of material, the manufacturer of the roll of material, etc. For example, certain rolls have a paperboard or cardboard core that supports the roll and defines the central bore 52 of the roll while other rolls are coreless. In other embodiments, the length of the rolls may vary. In a further embodiment, the roll may have been smashed or compressed during shipping or storing, thus yielding a bore that has a non-circular cross-sectional shape that results in a "wobbly" rotation. In other words, conventional roll holder shafts are not well-suited for the various types of rolls because the rotation of the roll, when in use, is unbalanced and/or generally destabilized.

The apparatus 100 of the present disclosure includes a first conical base 102 and a second conical base 104. In one embodiment, the conical bases 102, 104 have tapering sections 122, 142 (FIG. 1B) that are truncated cones. The smaller ends of the tapering sections 122, 142 can be inserted into opposing openings of the bore 52 of the roll 50 until the tapering sections 122, 142 contact the edges of the bore 52. This engagement prevents the inserted bases 102, 104 from being pushed too far into the center of the roll 50 and also stabilizes the roll 50 by preventing unwanted wobbling movement between the roll 50 and the apparatus 100. The tapering sections 122, 142 of the conical bases 102, 104 therefore provide stabilizing roll support for rolls that have slightly different lengths or for rolls that have different bore diameters. Additionally, if the bore 52 of the roll 50 has been compressed or smashed so that it has an oblong, non-circular cross-sectional shape, the inserted conical base structures 102, 104 may push or otherwise exert an inwards force from both sides of the roll 50 to "round" out any irregularities in the shape of the bore, thus further promoting a smooth rolling operation.

In one embodiment, the inserted portions of the tapering sections 122, 142 of the conical bases 102, 104 are detachably connected together within the bore 52 of the roll 50. Additional details regarding such an embodiment are included below with reference to FIGS. 3A and 3B.

The conical bases 102, 104 may also include flange sections 124, 144 from which the tapering sections 122, 142 extend. The flange sections 124, 144 may have roll-facing surfaces 125 that, according to certain embodiments, directly engage the edges of the roll 50 (as shown, for example, in FIG. 1A). The roll-facing surfaces 125 may further improve the stability of using the roll 50 of material by providing guided unwinding (and/or winding) of the material of the roll 50. In other words, the roll-facing surfaces 125 may facilitate the alignment of the material during use.

The conical bases 102, 104 also have through-holes 123, 143 that extend completely through the respective bases 102, 104. The through-holes 123, 143 enable the apparatus 100 to be employed with conventional roll holders. For example, a conventional toilet paper roll holder may have a spring-loaded roll holder shaft. Such a roll holder shaft may be inserted through the through-holes 123, 143 of the conical bases 102, 104, thus allowing the apparatus 100 to be used with most standard, pre-existing roll holder devices (e.g., toilet paper roll holder bracket secured to a bathroom wall). In one embodiment, the diameter of the through-holes 123, 143 is only slightly larger than the diameter of the roll holder shaft, thereby reducing any wobble that would otherwise occur between the conical bases 102, 104 and the roll holder shaft. For example, in one implementation the through-holes 123, 143 have a minimum diameter that is at most 0.25 inches larger than the maximum diameter of the roll holder shaft. In another implementation, the diameter of the through-holes 123, 143 is at most 0.10 inches larger than the diameter of the roll holder shaft.

The apparatus 100 may be constructed of various materials, including, but not limited to, metal, plastic, cardboard, paperboard, rubber, or a composite material, among others.

Figure 2:
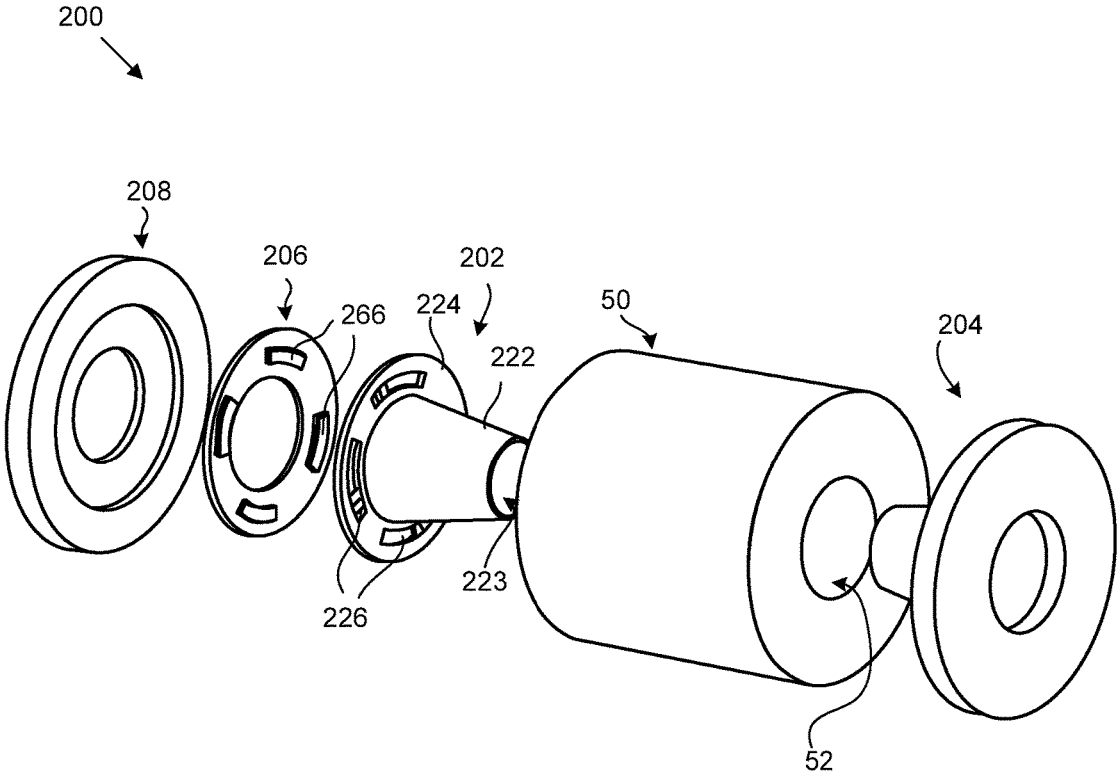
FIG. 2 is a perspective exploded view of another embodiment of the apparatus for stabilizing rotation of a roll of material.

FIG. 2 is a perspective exploded view of another embodiment of the apparatus 200 for stabilizing rotation of the roll 50 of material. In the depicted embodiment, the apparatus 200 includes, in addition to the first and second conical bases 202, 204, an attachment plate 206 and an end cap 208. Although in the depicted embodiment the attachment plate 206 and end cap 208 are only shown on one side of the roll 50, it is expected that in other embodiments the apparatus 200 may have such components disposed on both sides of the roll 50. The attachment plate 206 and/or the end cap 208 include connection features 266 that are complimentary with corresponding connection features 226 of the flange section 224 of the conical base 202 (in other embodiments, the attachment plate 206 may be omitted and the end cap 208 may directly attach to the flange section 224 of the conical base 202 via connection features). In other words, the attachment plate 206 and/or the end cap 208 are detachably coupleable with the conical bases 202, 204.

The connection features 226, 266 may include threads, clips, a rotational locking configuration, a pressure or friction fit lock, an interference fit and/or may utilize magnets, interlocking teeth, and/or other types of fasteners. For example, in one embodiment, threads may be disposed on an inwardly facing surface the cap 208 and an outer edge of the attachment plate (or flange section) may include corresponding threads. In another embodiment, small clips may be disposed on an inside of an end cap for interlocking with corresponding clips. The clips may have serrated type edges for additional grip.

In a further embodiment, a rotational locking configuration may be utilized by having a small protrusion extending from one of the conical bases (or the attachment plate 206) and the end cap 208 may have a groove or opening that receives the protrusion. The protrusion may lock/snap into place as the components are rotated relative to each other. Further details regarding connection features are included below with reference to FIGS. 3A and 3B (e.g., the connection features 326 and 346).

The attachment plate 206 and/or end cap 208 can be used to customize the appearance of the apparatus 200. For example, according to one embodiment the attachment plate 206 and/or end cap 208 are interchangeable to allow a user to select a custom color, material, and/or design. Thus, a user may have multiple end caps 208 that correspond with the décor of the room. In another embodiment, the end caps 208 and/or attachment plates 206 may coordinate with a holiday or season of the year. Different versions or models of the apparatus may include end caps 208 that have different aesthetic designs, different colors, different images, different logos, etc. In one embodiment, the end cap may be used as advertising space. For example, a restaurant or other public place may have end caps that have advertisements.

In one embodiment, the apparatus includes one or more electronic devices coupled to one or more of the conical bases 102, 104, the attachment plate 206, and/or the end cap 208. For example, the apparatus may include one or more lights (e.g., LEDs) which light up when the roll 50 rotates. In another embodiment, the apparatus may include a counter and/or a brake system to help control/prevent over rotation of the roll 50 (i.e., inadvertent unwinding of too much material). In yet another embodiment, the apparatus may include a speaker configured to play a song or recorded message when the roll 50 spins, or the like. Further, the apparatus may include a scented insert or a scent dispensing device. Further details regarding such accessories are included below with reference to FIGS. 6A and 6B.

Figure 3B:
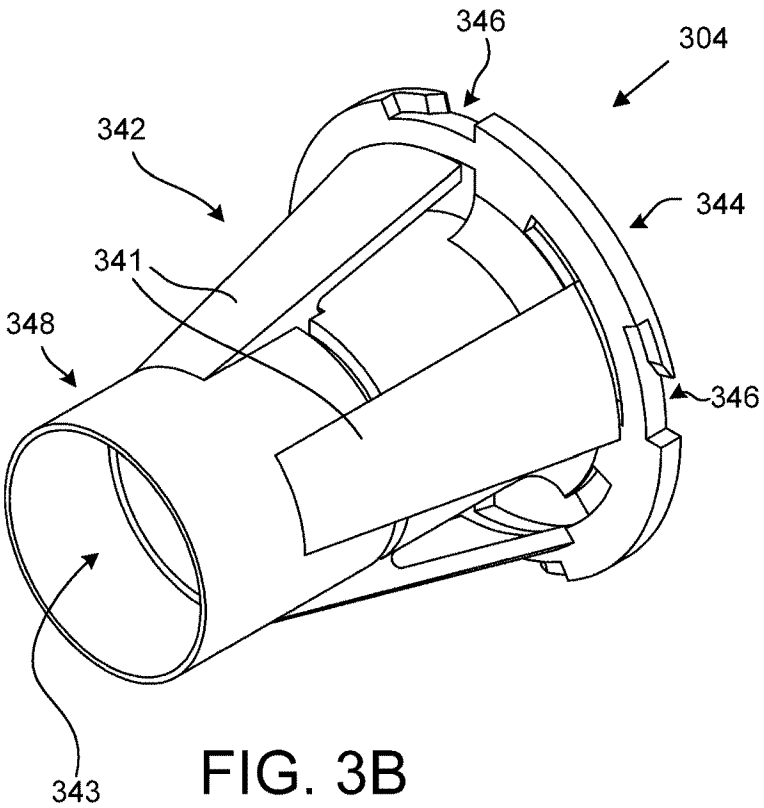
FIG. 3B is a perspective view of a second conical base of the apparatus for stabilizing rotation of a roll of material, according to one embodiment.
Figure 3A:
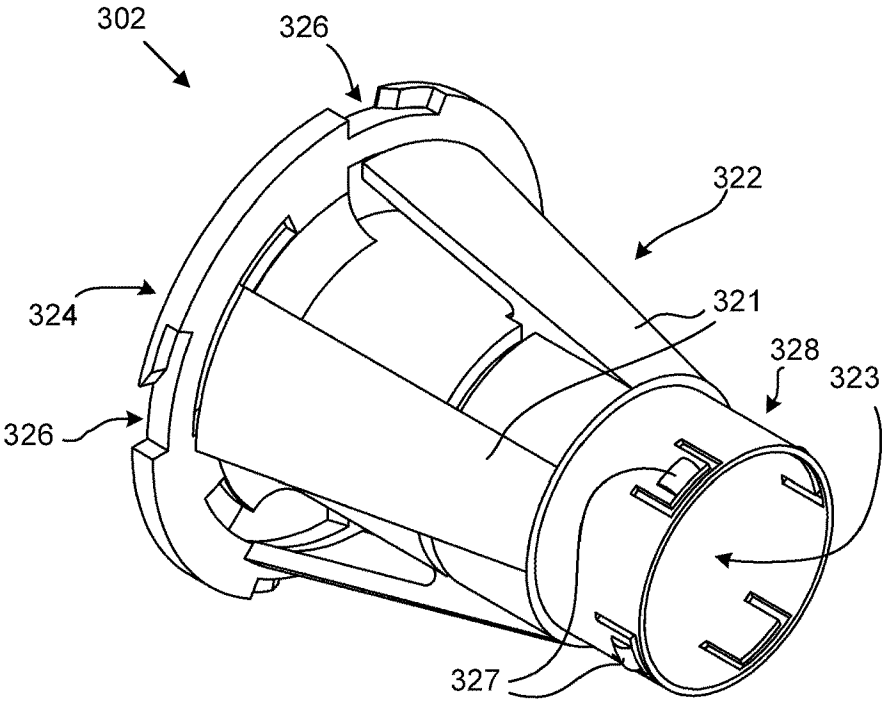
FIG. 3A is a perspective view of a first conical base of the apparatus for stabilizing rotation of a roll of material, according to one embodiment.

FIG. 3A is a perspective view of one embodiment of the first conical base 302 and FIG. 3B is a perspective view of one embodiment of the second conical base 304. In one embodiment, the tapering section 322, 342 of each conical base 302, 304 does not have a continuous conical surface. Instead, as shown in FIGS. 3A and 3B, a series of tapering panels 321, 341 may be implemented instead of a continuous conical surface. Thus, instead of a full and continuous cone surface, the tapering sections 322, 342 of the conical bases 302, 304 may have a plurality of cone-based (i.e., slanted) prongs extending an exterior surface of the through-holes 323, 343. For example, the tapering sections 322, 342 of the conical bases 302, 304 can each have a cylindrical extension that has a plurality of slanted prongs extending from the cylindrical extension. In one embodiment, the prongs may be resiliently bendable/deformable. For example, a free end of a resiliently bendable/deformable prong may improve the pressure imparted on the roll 50, thus promoting the stability of rotation of the roll.

In another embodiment, the tapering sections of the bases may have other designs and configurations, such as flexible rods which arc outward from the center, with a greater diameter toward the middle, or the like, to provide pressure on the roll 50.

In a different embodiment, the conical bases may be formed by elongate rods as a "frame" styled structure or the like. For example, rods may comprise prongs, a cylinder between prongs and a disk, each of the conical bases. In a further embodiment, the apparatus may have integrated spring loaded rod, integrated with and/or disposed within the through-holes 323, 343. The integrated spring loaded rod may replace an original holding rod for the roll 50. In certain embodiments, a small ledge inside of the conical bases may allow a user to retrofit the apparatus to have an integrated spring loaded rod insert (i.e., roll holder shaft). In one embodiment, the bases may include a bearing mechanism for smooth rotation of the conical bases and the roll 50 about a roll holder shaft.

As mentioned above, the conical bases 302, 304 may be detachably coupled together. For example, to prevent the conical bases 302, 304 from slipping out of the roll 50 during use (e.g., as the roll 50 turns), the inserted core base structures 300 may attach to each other on their small ends, as the ends meet in the center of the roll 50.

According to one embodiment, as depicted, the conical bases 302, 304 have respective sleeve portions 328, 348 that facilitate a releasable connection/engagement between the two conical bases 302, 304 when disposed within the bore 52 of the roll 50. According to the depicted embodiment, the first sleeve portion 328 of the first conical base 302 may be configured to sleeve within the second sleeve portion 348 of the second conical base 304. In one embodiment, an interference fit between the two sleeves may provide sufficient fastening means to hold the two conical bases together. In another embodiment, one of the sleeves 328, 348 includes engagement features 327 that facilitate the engagement between the two conical bases 302, 304. For example, as described above, a pressure or friction lock may include a ring or bumps on the inside and/or outside of the conical bases, so that when the bases are pressed together, they create a snug fit and thus impart pressure on the roll to stabilize the roll. In a further embodiment, each conical base may include corresponding magnetic materials which are magnetically attracted to maintain a predefined position.

In one embodiment, a feature disposed on an end of the conical bases may be adjustable to alter the length of the apparatus extending within the bore of the roll, thus enabling the apparatus to be used with rolls that have different lengths. In one embodiment, for example, a user may rotate one or both conical bases 302, 304 to adjust or set the length of the apparatus. In another embodiment, a connecting rod 472*b* may be coupled between the two conical bases and the connecting rod 472*b* may be swappable for other rods 472*b* of different lengths or may be adjustable in length to accommodate rolls of different sizes (i.e., width of the roll of material), such as the connecting rod 472*b* of FIG. 4B.

Figure 4A:
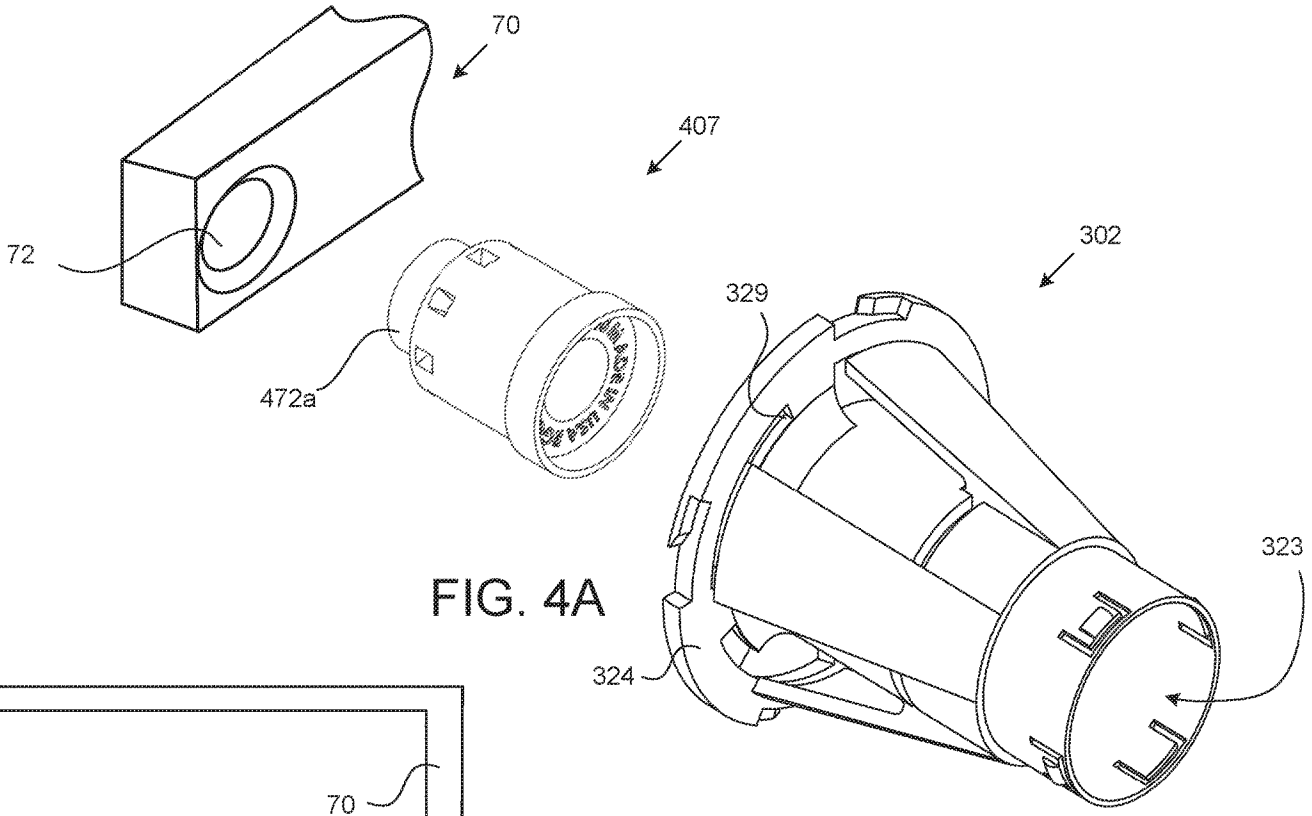
FIG. 4A is a perspective exploded view of a peripheral rod coupleable between a roll holder bracket and a conical base structure of the apparatus for stabilizing rotation of a roll of material, according to one embodiment
Figure 4B:
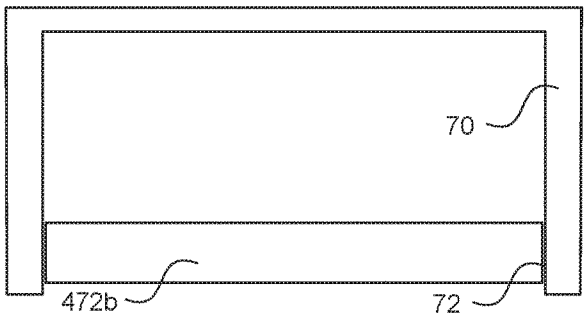
FIG. 4B is a top view of a roll holder bracket with a roll holder shaft and/or connecting rod, according to a further embodiment.

FIG. 4A is a perspective exploded view of a peripheral rod 407 coupleable between a roll holder bracket arm 70 and the conical base structure 302 of FIG. 3A. FIG. 4B is a top view of a roll holder bracket 70 with a roll holder shaft 472*b* and/or a connecting rod 472*b*. The peripheral rod 407 can be used instead of a conventional roll holder shaft 472*b*. The peripheral rod 407, according to one embodiment, does not extend completely through the through-hole 323 of the conical base 302 but instead connects to the flange section 324 and/or an inner surface of the through-hole 323 (e.g., an engagement feature 329). The peripheral rod 407 has a tip portion 472*a* that is engageable with a corresponding socket 72 of the roll holder bracket arm 70. Much like a conventional roll holder shaft 472*b*, the peripheral rod 407 may include a spring that biases the conical base 302 into stabilizing engagement with the roll of material (as described above). That is, with two peripheral rods 407 (one on each side of the roll of material) biasing the conical base structures 302.

Figure 5A:
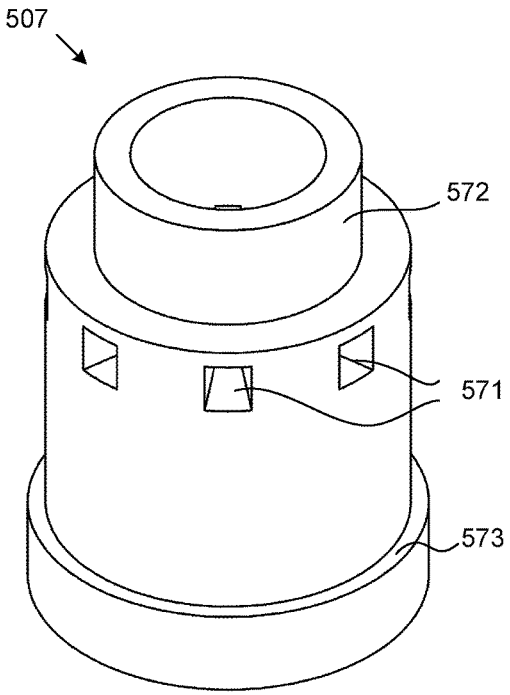
FIG. 5A is a perspective view of a peripheral rod of the apparatus for stabilizing rotation of a roll of material, according to one embodiment.
Figure 5B:
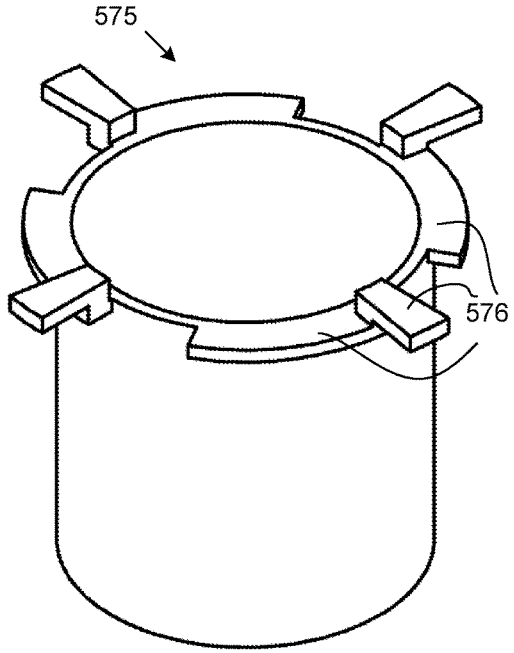
FIG. 5B is a perspective view of a rod backing component, according to one embodiment.
Figure 5C:
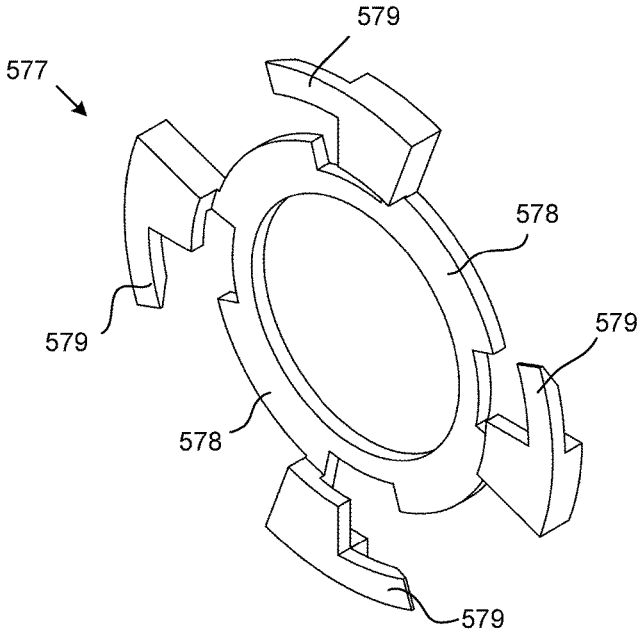
FIG. 5C is a perspective view of a rod backing cap, according to one embodiment.

FIGS. 5A-5C are perspective view of various components of the peripheral rod 507, according to a specific embodiment. FIG. 5A shows the peripheral rod 507 and FIG. 5B shows a peripheral rod sleeve 575. A spring or other biasing mechanism positioned within the central bore of the peripheral rod 507 and the peripheral rod 507 may be received into the sleeve 575 (with the tip portion 572 extending from the opening of the sleeve 575) so that the spring or other biasing mechanism is contained between the narrow tip 572 of the rod 507 and the bottom surface of the sleeve 575. The sleeve 575 includes engagement features 576 that interlock with complimentary engagement features 578 of a retaining ring 577 (FIG. 5C). With the peripheral rod 507 positioned partially within the sleeve 575, the retaining ring attaches (whether permanently or detachably) to the sleeve 575 and prevents the peripheral rod 507 from sliding out of the sleeve 575. In other words, the retaining ring 577 has an inner diameter that is less than an outer diameter of a shoulder portion 573 of the peripheral rod 507. Thus, the biasing nature of the spring allows the peripheral rod 507 to move longitudinally relative to the sleeve 575 but the retaining ring 577 limits such movement and prevents the peripheral rod 507 from falling out of the sleeve 575. The retaining ring 577 also has connection features 579 that interact with complimentary interlocking features (e.g., 329 in FIG. 4) that connect the retaining ring to the conical base structure. Thus, the roll holder bracket 70 engages the tip portion 572 of the peripheral rod 507, the peripheral rod 507 is positioned within the rod sleeve 575 and its biased, longitudinal movement relative to the rod sleeve 575 is limited by the retaining ring 577, which in turn is connected to the conical base.

Figure 6A:
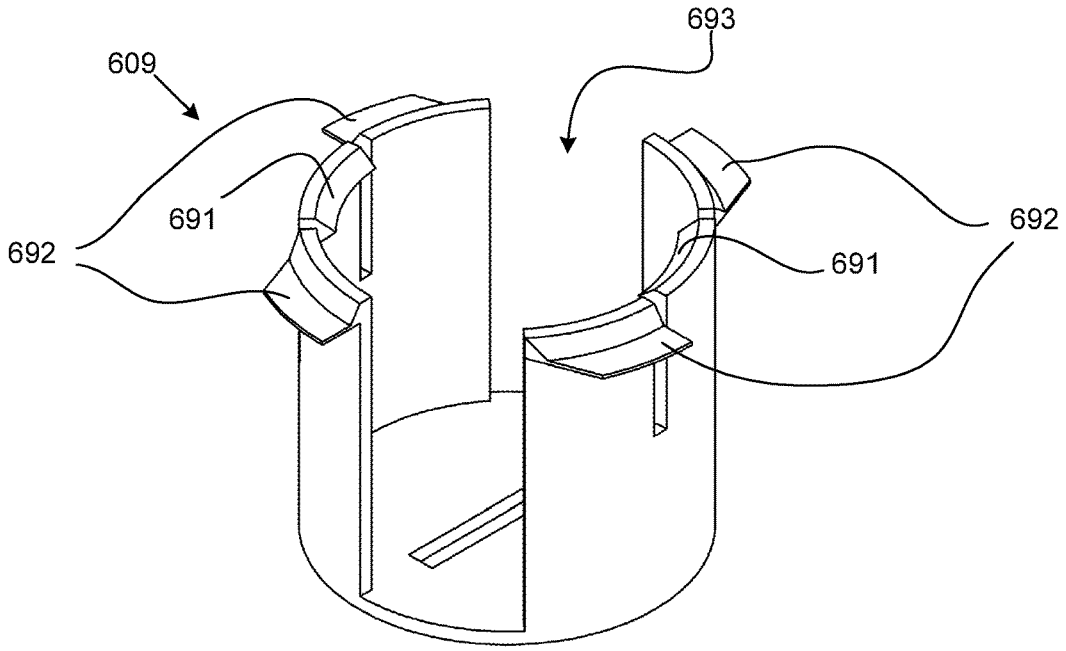
FIG. 6A is a perspective view of an accessory clip, according to one embodiment.
Figure 6B:
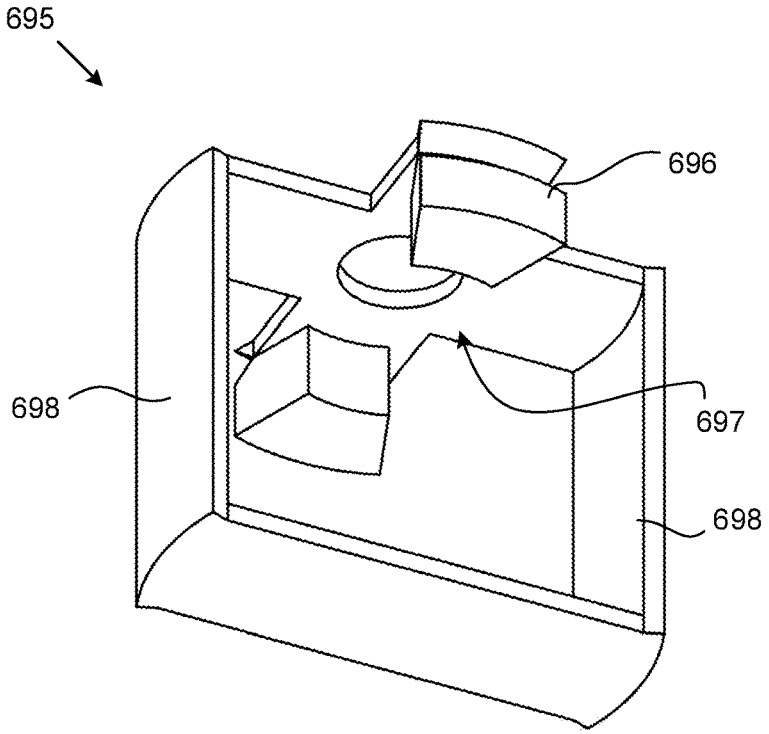
FIG. 6B is a perspective view of a light holder, according to one embodiment.

FIG. 6A is a perspective view of an accessory clip 609, according to one embodiment, and FIG. 6B is a perspective view of an accessory holder 695, according to one embodiment. As mentioned above, a light source (e.g., an LED mechanism), a noise emitter, a scent emitter, and/or other accessories may be included with the apparatus. According to the specific embodiment shown in FIGS. 6A and 6B, the accessory holder 695 has a mounting feature 697 or a mounting structure to which one or more accessories (lights, scent emitters, etc) may be mounted. The accessory holder 695 may be coupled directly to the conical bases 302, 304 or the accessory holder 695 may be coupled to the accessory clip 609 of FIG. 6A, for example.

The accessory holder 695 has sidewalls 698 that loosely define a chamber within which the accessory is housed/mounted. The sidewalls 698 can be received within corresponding gaps/grooves 693 of the accessory clip 609. The accessory clip 609 has retaining features 691 that interlock with engagement features 696 of the accessory holder 695 to secure the accessory holder 695 within the clip 609. The accessory clip 609 also has connection features 692 that interlock with corresponding engagement features of the conical base, thereby enabling the accessory clip 609 to be inserted within the hollow cylindrical inner sleeve 328 of the first conical base 302. As show in FIG. 5A, the peripheral rod 507 may have apertures 571 that extend through the peripheral rod 507 to allow light or scent from the held accessory to diffuse from the central cylindrical chamber of the conical bases and into ambient.

Figure 7:
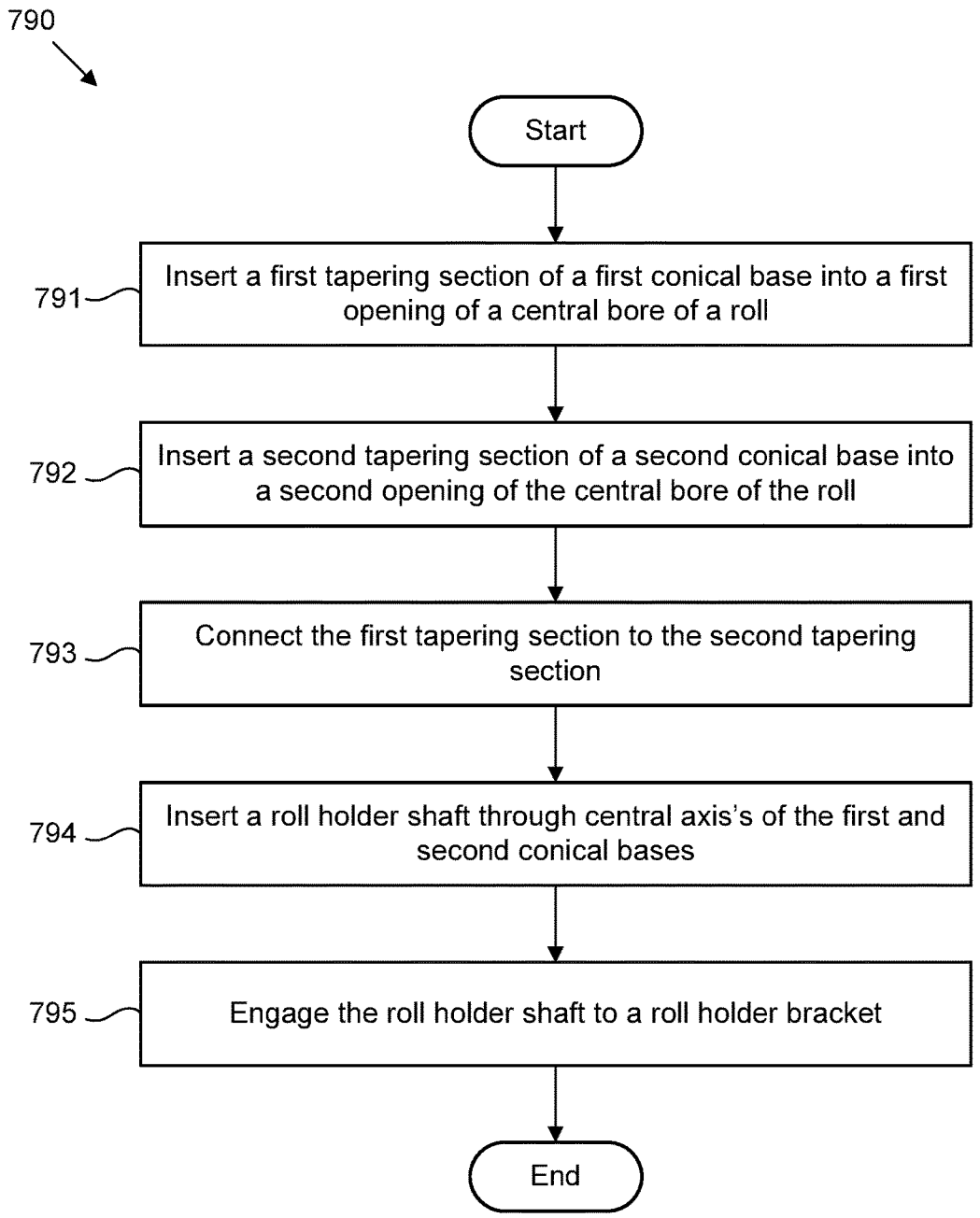
FIG. 7 is a schematic flow chart diagram of one embodiment of a method for stabilizing rotation of a roll of material.

FIG. 7 is a schematic flow chart diagram of one embodiment of a method 790 for stabilizing rotation of a roll of material. The method 790 includes inserting 791 a first tapering section of a first conical base into a first opening of a central bore of the roll. As described above, the first conical base has a first through-hole extending completely through the first conical base along a first central axis. The method 790 further includes inserting 792 a second tapering section of a second conical base into a second opening opposite the first opening of the central bore of the roll. The second conical base has a second through-hole extending completely through the second conical base along a second central axis. The method 790 further includes connecting 793 the first tapering section of the first conical base to the second tapering section of the second conical base, inserting 794 a roll holder shaft through the first and second central axis's of the first and second conical bases, respectively, and engaging 795 the roller holder shaft to a roll holder bracket.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C; or some other suitable combination. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Aspects of the embodiments may be described above with reference to schematic flowchart diagrams and/or schematic block diagrams of methods, apparatuses, and systems according to embodiments of the disclosure. The schematic flowchart diagrams and/or schematic block diagrams in the figures illustrate the architecture, functionality, and operation of possible implementations of apparatuses, and systems according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment.

The subject matter of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An apparatus for stabilizing a roll of material, the apparatus comprising:

a first conical base having a first through-hole extending completely through the first conical base along a first central axis, the first conical base comprising a first tapering section circumscribing and concentric with the first through-hole, the first tapering section configured to be inserted into a first opening of a central bore of the roll; and a second conical base having a second through-hole extending completely through the second conical base along a second central axis, the second conical base comprising a second tapering section circumscribing and concentric with the second through-hole, the second tapering section configured to be inserted into a second opening opposite the first opening of the central bore of the roll;

wherein engagement between the roll and the first and second conical base structures operably stabilizes rotation of the roll and the first and second conical bases are detachably coupleable with each other.

2. The apparatus of claim 1, wherein the first and second conical base structures comprise first and second flange sections, respectively, wherein the first and second tapering sections extend from the first and second flange sections, respectively.

3. The apparatus of claim 2, wherein the first and second flange sections comprise roll-facing surfaces, wherein the roll-facing surfaces engage opposite ends of the roll to facilitate at least one of guided unwinding and guided winding of the material of the roll.

4. The apparatus of claim 2, wherein swappable end caps are detachably coupleable to the first and second flange sections.

5. The apparatus of claim 2, further comprising a first and a second peripheral rod, wherein the first and second peripheral rods are coupleable between a roll holder bracket and at least one of the flange section and the through-hole of the first and second conical bases, respectively.

6. The apparatus of claim 1, wherein at least portions of inner surfaces of the first and second-through holes are configured to directly engage a roll holder shaft extending therethrough.

7. The apparatus of claim 6, wherein a minimum diameter of the first and second-through holes is at most 0.25 inches larger than a maximum diameter of the roll holder shaft, wherein the first and second central axis's of the first and second conical bases, respectively, are substantially coaxial with a third central axis of the roll holder shaft.

8. The apparatus of claim 1, wherein the first and second conical bases have complimentary connection features that facilitate the detachable coupling with each other.

9. The apparatus of claim 1, further comprising a connecting rod, wherein the first and second conical bases are detachably coupleable together via the connecting rod.

10. An apparatus for stabilizing a roll of material, the apparatus comprising:

a first conical base having a first through-hole extending completely through the first conical base along a first central axis, the first conical base comprising a first tapering section circumscribing and concentric with the first through-hole, the first tapering section configured to be inserted into a first opening of a central bore of the roll;

a second conical base having a second through-hole extending completely through the second conical base along a second central axis, the second conical base comprising a second tapering section circumscribing and concentric with the second through-hole, the second tapering section configured to be inserted into a second opening opposite the first opening of the central bore of the roll;

a roll holder bracket configured to secure to a wall, wherein the roll holder bracket comprises two arms; and a roll holder shaft configured to extend between the two arms of the roll holder bracket and configured to extend through the first and second-through holes of the first and second conical base structures, respectively, wherein at least portions of inner surfaces of the first and second-through holes are configured to directly engage the roll holder shaft;

wherein engagement between the roll and the first and second conical base structures operably stabilizes rotation of the roll and the first and second conical bases are detachably coupleable with each other.

11. The apparatus of claim 10, wherein the first and second conical base structures comprise first and second flange sections, respectively, wherein the first and second tapering sections extend from the first and second flange sections, respectively.

12. The apparatus of claim 11, wherein the first and second flange sections comprise roll-facing surfaces, wherein the roll-facing surfaces engage opposite ends of the roll to facilitate at least one of guided unwinding and guided winding of the material of the roll.

13. The apparatus of claim 11, wherein swappable end caps are detachably coupleable to the first and second flange sections.

14. The apparatus of claim 10, wherein a minimum diameter of the first and second-through holes is at most 0.25 inches larger than a maximum diameter of the roll holder shaft, wherein the first and second central axis's of the first and second conical bases, respectively, are substantially coaxial with a third central axis of the roll holder shaft.

15. The apparatus of claim 10, wherein the first and second conical bases have complimentary connection features that facilitate the detachable coupling with each other.

16. The apparatus of claim 10, further comprising a connecting rod, wherein the first and second conical bases are detachably coupleable together via the connecting rod.

17. A method for stabilizing rotation of a roll of material, the method comprising:

inserting a first tapering section of a first conical base into a first opening of a central bore of the roll, wherein the first conical base comprises a first through-hole extending completely through the first conical base along a first central axis;

inserting a second tapering section of a second conical base into a second opening opposite the first opening of the central bore of the roll, wherein the second conical base comprises a second through-hole extending completely through the second conical base along a second central axis, wherein the first and second conical bases are detachably coupleable with each other;

connecting the first tapering section of the first conical base to the second tapering section of the second conical base;

inserting a roll holder shaft through the first and second central axis's of the first and second conical bases, respectively; and engaging the roller holder shaft to a roll holder bracket.

* * * * *